US005433192A

United States Patent [19]

Ebeling

[11] Patent Number: 5,433,192

[45] Date of Patent: Jul. 18, 1995

[54] BREATHING MASK HAVING A CELLULOSE HEAT AND MOISTURE EXCHANGER FORMED THEREIN

[75] Inventor: Olavi Ebeling, Helsinki, Finland

[73] Assignee: Insinooritoimisto Megsent Oy, Kerava, Finland

[21] Appl. No.: 81,244

[22] PCT Filed: Nov. 9, 1991

[86] PCT No.: PCT/FI91/00332

§ 371 Date: Jul. 20, 1993

§ 102(e) Date: Jul. 20, 1993

[87] PCT Pub. No.: WO92/11888

PCT Pub. Date: Jul. 23, 1992

[30] Foreign Application Priority Data

Dec. 28, 1990 [FI] Finland ..... 906448

[51] Int. Cl.[6] ..... A62B 18/08; A62B 7/10; A62B 23/02

[52] U.S. Cl. ..... 128/201.13; 128/206.22; 128/206.12

[58] Field of Search ..... 128/201.13, 204.17, 128/206.19, 206.12, 206.22, 203.16, 203.17, 203.26, 203.27

[56] References Cited

U.S. PATENT DOCUMENTS

| | | | |
|---|---|---|---|
| 3,326,214 | 6/1967 | McCoy | 128/201.13 |
| 3,333,585 | 8/1967 | Barghini . | |
| 3,814,094 | 6/1974 | De Angelis . | |
| 4,136,691 | 1/1979 | Ebeling . | |
| 4,319,567 | 3/1982 | Magidson . | |
| 4,323,063 | 4/1982 | Fisichella | 128/206.12 |
| 5,007,114 | 4/1991 | Numano | 128/201.13 |
| 5,010,594 | 4/1991 | Suzuki et al. | 128/201.13 |

FOREIGN PATENT DOCUMENTS

| | | | |
|---|---|---|---|
| 895044 | 4/1991 | Finland . | |
| 201960 | 2/1966 | Sweden | 128/201.13 |
| 432709 | 4/1984 | Sweden . | |

*Primary Examiner*—Kimberly L. Asher
*Attorney, Agent, or Firm*—Townsend & Townsend Khourie & Crew

[57] ABSTRACT

The invention relates to a breathing mask comprising a mask portion (1) covering the mouth and nose of the wearer and a heat exchanger portion (2) made of a material capable of recovering heat and fitted in the mask portion (1), inhalation and exhalation air being arranged to flow through the heat exchanger portion to recover heat and moisture contained in the exhalation air and to transfer it into the inhalation air. To achieve a simple, light structure having no disadvantageous environmental effects, the mask portion (1) and the heat exchanger portion (2) are made of the same material, preferably of a biodegradable material.

13 Claims, 1 Drawing Sheet

BREATHING MASK HAVING A CELLULOSE HEAT AND MOISTURE EXCHANGER FORMED THEREIN

The invention relates to a breathing mask comprising a mask portion covering the mouth and the nose of the wearer and a heat exchanger portion made of a material capable of recovering heat and fitted in the mask portion, inhalation and exhalation air being arranged to flow through the heat exchanger portion to recover heat and moisture contained in the exhalation air and to transfer them into the inhalation air.

BACKGROUND OF THE INVENTION

A person working at subzero temperatures under winter conditions or staying outdoors under very cold conditions in general, e.g. in arctic areas, has to breath in great amounts of cold, dry air. This is not only unhealthy but also substantially increases the loss of heat of the person as the body tends to warm up the inhalation air to the temperature of the body and this amount of heat is removed from the body with the exhalation air. In addition, dry inhalation air has a disadvantageous effect on the normal moistness of the mucous membrane of the respiratory passages.

Various breathing masks are previously known which are intended for use when working at subzero temperatures, whereby the purpose of the mask is to enable the recovery of heat and moisture from the exhalation air and to transfer them into the inhalation air. Examples of such known masks are those disclosed in FI Patent Specifications 49241 and 52019 and FI Patent Application 895044.

In principle, the masks described in the abovementioned patent documents operate completely flawlessly, but their usability is not the best possible. One factor impairing their usability is their impractical design, as the shape of the masks deviates substantially from the shape of the wearer's face. As the mask protrudes strongly from the face, its usability is substantially deteriorated. With some of these masks, a further drawback is the great weight caused by the disadvantageous shape of the heat exchanger portion, which in some cases requires the use of a rather large mask portion.

The solution disclosed in FI Patent Application 895044 provides a considerable improvement over the solutions disclosed in the above-mentioned Patent Specifications. The only major drawback of the solution of FI Patent Application 895044 is that the cost of manufacture of the construction cannot be reduced to such an extent that it would be profitable to sell the mask as a disposable product in connection with a sports competition, for example. Another factor speaking against disposability is that the materials used in the manufacture of this breathing mask are not biodegradable, and so the disposability would cause environmental problems. The solutions described in FI Patent Specifications 49241 and 52019 have the same drawback.

The object of the invention is to provide a breathing mask by means of which the drawbacks of the prior art can be eliminated. This is achieved by means of a breathing mask of the invention, which is characterized in that the mask portion and the heat exchanger portion are made of the same material.

SUMMARY OF THE INVENTION

An advantage of the invention is mainly that it is simple and provides a construction such that it can be disposed of without causing environmental problems and nevertheless has all the advantages of the previous masks. The protective capacity of the breathing mask according to the invention is fully comparable with that of the previous solutions, in addition to which the mask according to the invention degrades biologically relatively rapidly, which eliminates the environmental problems often associated with disposable products. Moreover, the breathing mask according to the invention is advantageous in manufacturing costs, and so the price of the finished product can be kept sufficiently low. Still another advantage of the invention is that the heat surfaces are substantially parallel with the flow of air and the flow openings are accurately defined. This is of vital importance in view of the flow resistance.

DESCRIPTION OF THE PREFERRED EMBODIMENT

Figure 1:
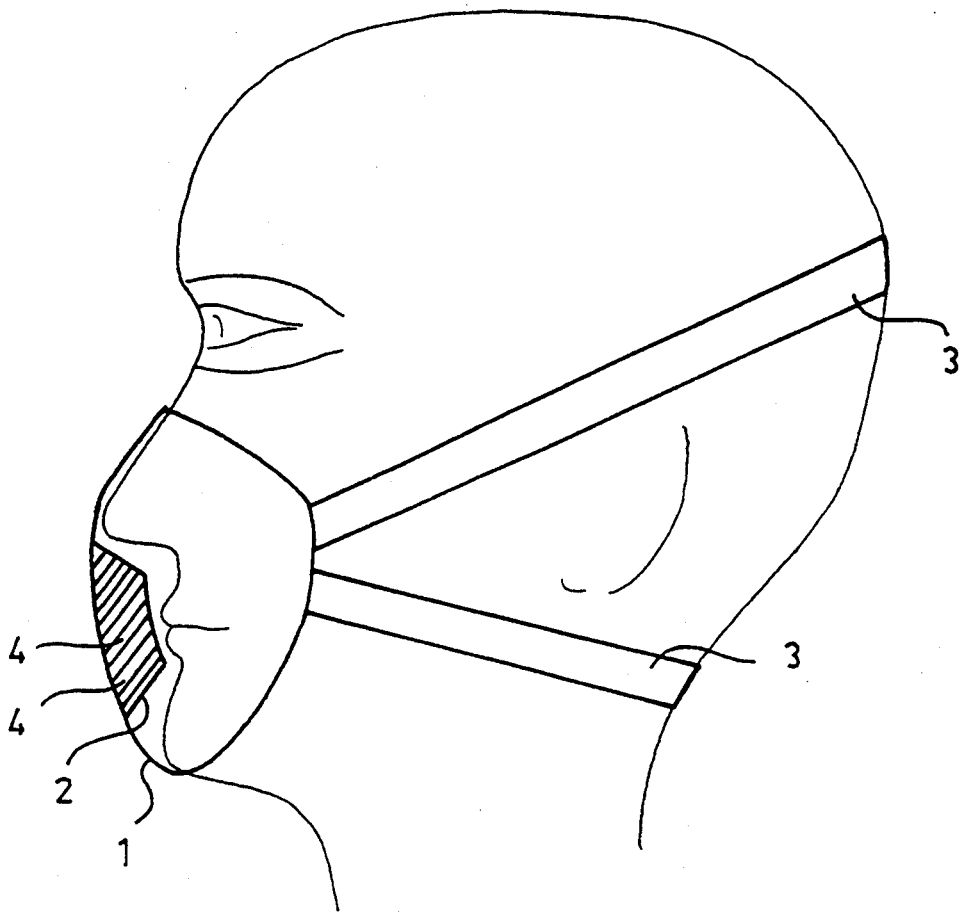
FIG. 1 shows a breathing mask according to the invention when positioned upon the face of the wearer.
Figure 2:
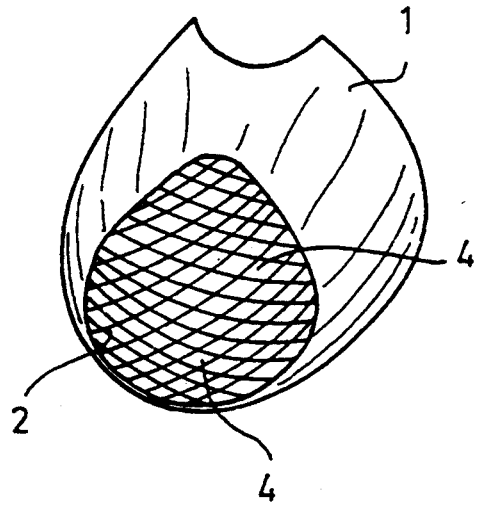
FIG. 2 is a perspective view of the breathing mask according to the invention.

The figures illustrate the principal features of the preferred embodiment of the invention. The reference numeral 1 indicates a mask portion covering the mouth and the nose of the wearer, and the reference numeral 2 indicates a heat exchanger portion. The heat exchanger portion 2 is fitted in the mask portion in such a way that the inhalation and exhalation air flows through it. At the exhalation stage, the heat exchanger portion 2 recovers heat and moisture from the exhalation air and transfers them into the inhalation air at the inhalation stage. In FIG. 1, the reference numeral 3 indicates bands by means of which the mask is fixed upon the wearer's face.

According to the basic idea of the invention, the mask portion 1 and the heat exchanger portion 2 are made of the same material. It has proved to be especially advantageous to make both the heat exchanger portion 2 and the mask portion 1 of a biodegradable material. The biodegradable material may be e.g. wood fibre.

The heat exchanger portion 2 and the mask portion can be manufactured as separate parts and combined into a whole shown in the figures. However, it has proved to be especially advantageous to manufacture the heat exchanger portion 2 and the mask portion 1 in a single step into an integral and seamless structure.

The breathing mask according to the invention can be manufactured e.g. by a drainage technique, in which fibres are drained by means of water into a mould or casting model. Another alternative is a so-called air-laying technique, in which air is sucked through a casting model positioned on a wire.

The above-mentioned mould or casting model can be formed of a body having crossing slits by means of which a cavity or duct structure comprising several parallel ducts 4 can be formed of the wood fibre material. The ducts appear clearly from FIG. 1 in particular. The cross-section of the ducts 4 may be e.g. rhombic or rhomboidal. The length of the ducts 4 should be in the order of 15 to 20 mm, and the wall thickness should be about 0.5 to 1 mm. The walls between the ducts 4 need not be air-tight because more surface area is obtained in this way.

The breathing mask according to the invention can be made of short-fibred high-yield hardwood cellulose, such as eucalyptus CTMP fibres. Another example is native aspen CTMP pulp. If the duct system requires handling strength to some extent, a small amount, e.g. about 10% of spruce CTMP pulp can be added to the short-fibred pulp. When the fibre network has been formed around a cast mould or the like positioned on a wire, e.g. a starch solution can be applied through this very porous fibre network, if required. In the air-laying technique, it is possible to spray a starch aerosol into the air flow of the fibres, whereby the fibre network is stiffened to some extent already in connection with the drainage.

The heat exchanger portion 2, that is, the duct system, and the mask portion have to be saturated due to the moisture contained in breathing air. The duct system and the mask portion can be saturated e.g. by any biodegradable polymer.

As mentioned above, the length of the ducts 4 of the heat exchanger portion 2 should be about 15 to 20 mm to provide a sufficient heat transfer capacity. Ducts of such a length can be advantageously positioned as shown in FIG. 1, whereby the heat exchanger portion does not substantially protrude from the outer surface of the wearer's face. By suitably shaping the heat exchanger portion, a sufficient surface area is provided in the duct system to obtain the required heat transfer capacity. One aims at a large heat storing mass and, correspondingly, at a high surface area/mass ratio on account of the heat transfer rate. The mask portion 1 is made gas-tight, which ensures that all breathing air passes through the heat exchanger portion 2.

The above embodiment is not intended to restrict the invention in any way, but the invention can be modified as desired within the scope of the claims. Accordingly, it is obvious that the breathing mask according to the invention or its details need not necessarily be similar to those shown in the figures but other solutions are possible as well. The mask, for instance, need not necessarily be fastened in place by means of bands; instead, the mask portion can be fastened to a hood or the like. The mask portion may also be integral with the hood, etc. The mask portion is, of course, such that it adapts to the shape of the wearer's face. The mask portion is preferably such that it can be shaped by the wearer and that it remains in this shape. In addition to wood fibre, many other materials can be used in the manufacture of the breathing mask according to the invention. Such materials include a wood fibre material saturated by any polymer, such as a biodegradable polymer, starch, various plastic materials, that is, biodegradable and, if required, also non-degradable plastics, etc.

I claim:

1. A breathing mask comprising:

a heat exchanger portion made of a material capable of recovering heat, the heat exchanger portion being arranged to receive exhalation air recover heat and moisture contained in the exhalation air, and transfer said heat and moisture to inhalation air;

a mask portion surrounding the heat exchanger portion and configured to cover the mouth and the nose of the wearer, the mask portion being essentially impermeable to gas; and wherein the mask portion and the heat exchanger portion comprise a light weight biodegradabe cellulose material that is saturated with a polymer to stiffen the cellulose material will resist moisture.

2. A breathing mask according to claim 1, wherein: the heat exchange portion and the mask portion form an integral seamless structure made in a single step.

3. A breathing mask according to claim wherein: the material used in the manufacture is wood fibre.

4. A breathing mask according to claim 4, wherein: the wood fibre material comprises a short-fibred fibre material.

5. A breathing mask according to claim 1, wherein: the material used in the manufacture comprises a wood fibre material saturated with a biodegradable polymer.

6. A breathing mask according to claim 5, wherein the polymer comprises starch.

7. A breathing mask according to claim 1, wherein: the material comprises plastic.

8. The breathing mask of claim 1, wherein:

the mask portion and the heat exchanger portion consist of the same material.

9. A breathing mask, comprising:

a mask portion;

a heat exchanger portion having a plurality of ducts, the heat exchanger portion being configured to receive exhalation air, recover heat and moisture contained in the exhalation air, and transfer said heat and moisture to inhalation air, the ducts having a length of at least 15 mm to facilitate heat exchange between the ducts and the inhalation and exhalation air; and wherein the mask portion and the heat exchanger each comprise a lightweight biodegradable cellulose material saturated with a polymer to stiffen the cellulose material so that the cellulose material will resist moisture.

10. The breathing mask of claim 9, wherein:

the plurality of ducts have a length in the order of 15 to 20 mm.

11. The breathing mask of claim 9, wherein:

the plurality of ducts have a rhombic cross-sectional shape.

12. The breathing mask of claim 9, wherein:

the plurality of ducts are parallel to one another.

13. The breathing mask of claim 9, wherein:

the plurality of ducts have a wall thickness between 0.5 and 1 mm.

* * * * *

UNITED STATES PATENT AND TRADEMARK OFFICE

CERTIFICATE OF CORRECTION

PATENT NO. : 5,433,192

DATED : July 18, 1995

INVENTOR(S) : Olavi Ebeling

It is certified that error appears in the above-identified patent and that said Letters Patent is hereby corrected as shown below:

On the title page, under item [22], change "November 9, 1991" to --November 1, 1991--.

Signed and Sealed this

Twenty-first Day of November, 1995

Bruce Lehman

*Attest:*

BRUCE LEHMAN

*Attesting Officer*

*Commissioner of Patents and Trademarks*